US008231186B1

(12) United States Patent
Gilbert

(10) Patent No.: US 8,231,186 B1
(45) Date of Patent: Jul. 31, 2012

(54) HANGING FOLDER STOP

(76) Inventor: William D. Gilbert, La Quinta, CA (US)

( * ) Notice: Subject to any disclaimer, the term of this patent is extended or adjusted under 35 U.S.C. 154(b) by 164 days.

(21) Appl. No.: 12/564,393

(22) Filed: Sep. 22, 2009

(51) Int. Cl.
*B42F 15/00* (2006.01)
*A47B 88/00* (2006.01)

(52) U.S. Cl. ..... 312/184; 312/348.3

(58) Field of Classification Search ..... 312/348.3, 312/330.1, 183; 220/544, 545, 543, 529; 24/460, 461, 462
See application file for complete search history.

(56) References Cited

U.S. PATENT DOCUMENTS

| | | | | | |
|---|---|---|---|---|---|
| 2,233,938 | A | * | 3/1941 | Jones | 220/529 |
| 2,937,765 | A | | 5/1960 | Shank | |
| 3,222,448 | A | * | 12/1965 | Rogers et al. | 174/395 |
| 3,748,008 | A | * | 7/1973 | Pryor | 312/184 |
| 4,081,100 | A | * | 3/1978 | Presby | 220/544 |
| 4,102,470 | A | * | 7/1978 | Timmons | 220/543 |
| D248,705 | S | | 8/1978 | Thomas | |
| 4,234,238 | A | | 11/1980 | Figueroa | |
| 4,703,982 | A | * | 11/1987 | Rock et al. | 312/330.1 |
| 4,903,629 | A | * | 2/1990 | Maudlin et al. | 114/361 |
| 5,127,538 | A | * | 7/1992 | Bach | 220/529 |
| 5,182,827 | A | * | 2/1993 | Carrier et al. | 5/498 |
| 5,190,183 | A | * | 3/1993 | McNaughton et al. | 220/551 |
| 5,237,732 | A | * | 8/1993 | Polak et al. | 29/413 |
| 5,261,636 | A | * | 11/1993 | Hawes et al. | 281/45 |
| 5,395,049 | A | * | 3/1995 | Huhn | 229/120.02 |
| 5,400,929 | A | * | 3/1995 | Lopez Gonzalez | 222/544 |
| 5,611,123 | A | * | 3/1997 | Prizzi | 24/459 |
| 5,676,439 | A | * | 10/1997 | Occhipinti et al. | 312/183 |
| D388,695 | S | * | 1/1998 | Alcini | D8/395 |
| 5,806,941 | A | * | 9/1998 | Diederich et al. | 312/183 |
| 5,983,460 | A | * | 11/1999 | Hyde et al. | 24/30.5 R |
| D426,577 | S | * | 6/2000 | Mackey et al. | D19/89 |
| 6,148,488 | A | * | 11/2000 | Gristock | 24/462 |
| 6,292,987 | B1 | * | 9/2001 | Combes | 24/460 |
| 7,197,844 | B2 | * | 4/2007 | Benson | 42/94 |
| 7,429,089 | B2 | | 9/2008 | Arney | |
| 2003/0154579 | A1 | * | 8/2003 | Disher | 24/462 |
| 2005/0040746 | A1 | | 2/2005 | Woodrow | |
| 2007/0000100 | A1 | * | 1/2007 | Smith | 24/460 |

* cited by examiner

*Primary Examiner* — David Dunn
*Assistant Examiner* — Ryan A Doyle

(57) ABSTRACT

A hanging folder stop that is used in conjunction with a drawer in a filing cabinet that utilizes hanging folders. The hanging folder stop is fabricated from a length of plastic tubing that can be removably mounted onto a side wall of the filing cabinet drawer. Once a number of hanging folder stops have been mounted onto both the left and right side walls of the filing cabinet drawer, the hanging folders that are mounted on the side walls of the drawer will be forced to remain in a position roughly close to parallel with the front and rear panels of the drawer, thereby preventing the folders from dismounting from the side panels of the drawer and falling into the drawer itself.

3 Claims, 2 Drawing Sheets

HANGING FOLDER STOP

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved hanging folder stop that is used in conjunction with a drawer in a filing cabinet that utilizes ii hanging folders.

SUMMARY OF THE INVENTION

The present invention concerns that of a new and improved hanging folder stop that is used in conjunction with a drawer in a filing cabinet that utilizes hanging folders. The hanging folder stop is fabricated from a length of plastic tubing that can be removably mounted onto a side wall of a filing cabinet drawer. Once a number of hanging folder stops have been mounted onto both the left and right side walls of a particular filing cabinet drawer, the hanging folders that are mounted on the side walls of the drawer will be forced to remain close to parallel with the front and rear panels of the drawer, thereby preventing the folders from dismounting from the side panels of the drawer and falling into the drawer itself.

There has thus been outlined, rather broadly, the more important features of a hanging folder stop that the detailed description thereof that follows may be better understood and in order that the present contribution to the art may be better appreciated. There are, of course, additional features of the hanging folder stop that will be described hereinafter and which will form the subject matter of the claims appended hereto.

In this respect, before explaining at least one embodiment of the hanging folder stop in detail, it is to be understood that the hanging folder stop is not limited in its application to the details of construction and to the arrangements of the components set forth in the following description or illustrated in the ii drawings. The hanging folder stop is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present hanging folder stop. It is important, therefore, that the claims be regarded as including such equivalent constructions insofar as they do not depart from the spirit and scope of the present invention.

It is therefore an object of the present invention to provide a hanging folder stop which has all of the advantages of the prior art and none of the disadvantages.

It is another object of the present invention to provide a hanging folder stop which may be easily and efficiently manufactured and marketed.

It is another object of the present invention to provide a hanging folder stop which is of durable and reliable construction.

It is yet another object of the present invention to provide a hanging folder stop which is economically affordable and available for relevant market segment of the purchasing public.

Other objects, features and advantages of the present invention will become more readily apparent from the following detailed description of the preferred embodiment when considered with the attached drawings and ii appended claims.

DESCRIPTION OF THE PREFERRED EMBODIMENT

Figure 1:
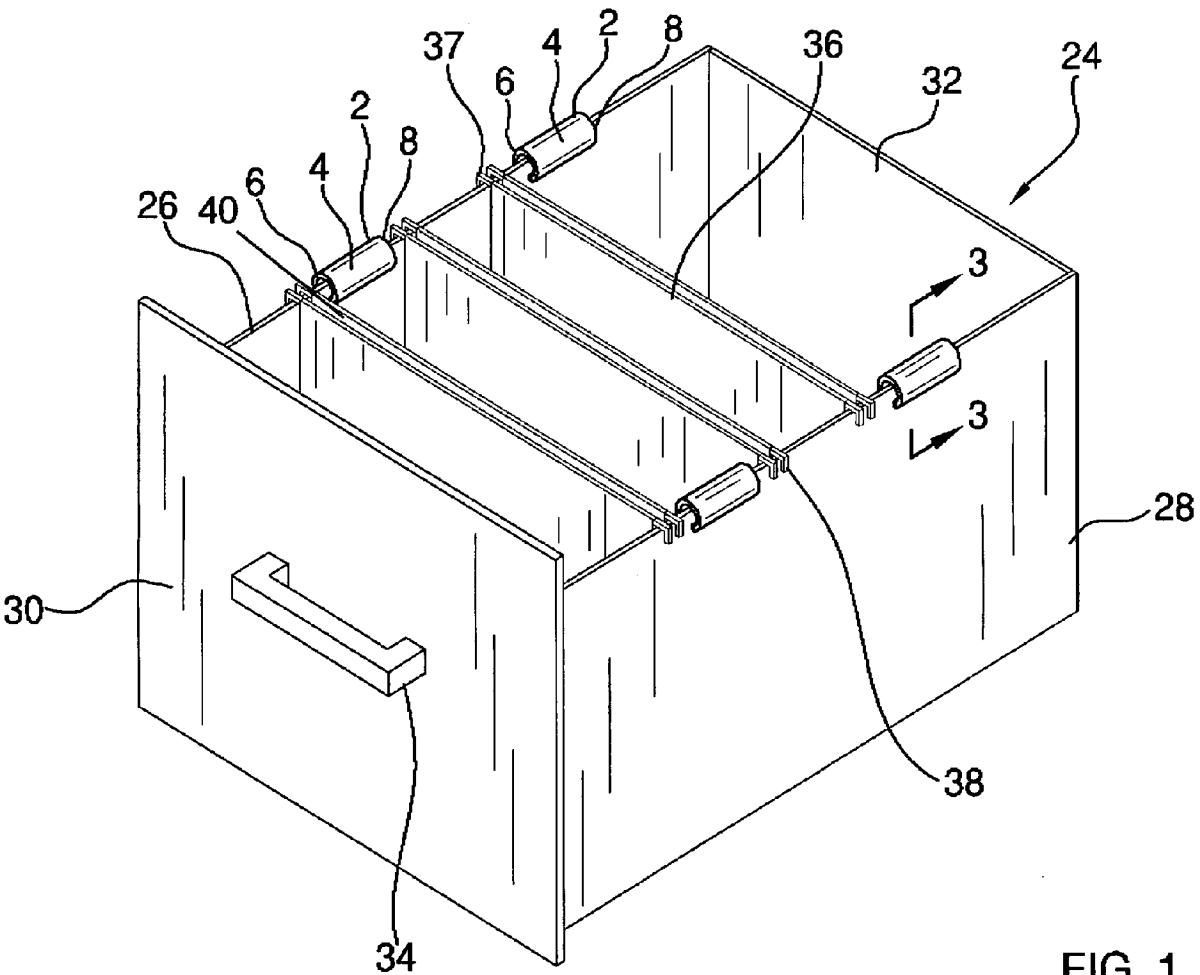
FIG. 1 shows a front upper perspective view of a filing cabinet drawer with several of the hanging folder stops strategically positioned on the left and right side walls of the drawer.
Figure 3:
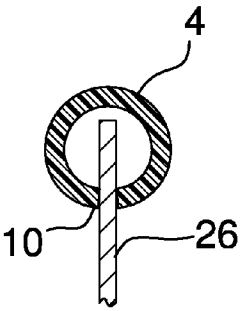
FIG. 3 shows an end view of a hanging folder stop, with the left side wall of the drawer 24 having been inserted into the slotted opening.
Figure 5:
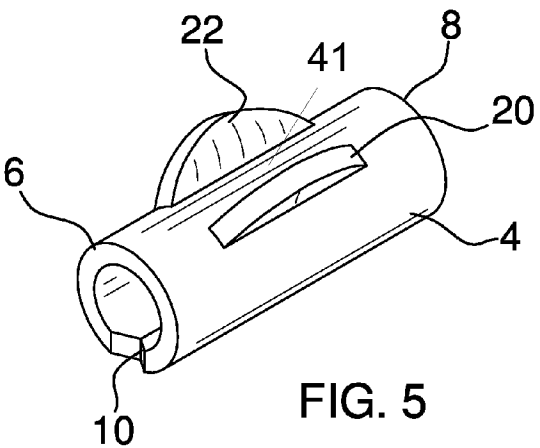
FIG. 5 shows a front upper perspective view of a hanging folder stop, highlighting the positioning of the first and second grips attached to the plastic tubing.
Figure 2:
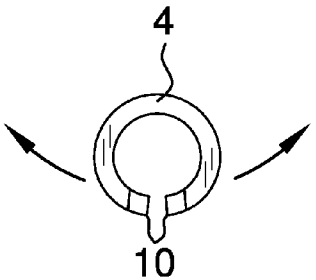
FIG. 2 shows an end view of a hanging folder stop, with the slotted opening being slightly opened.
Figure 4:
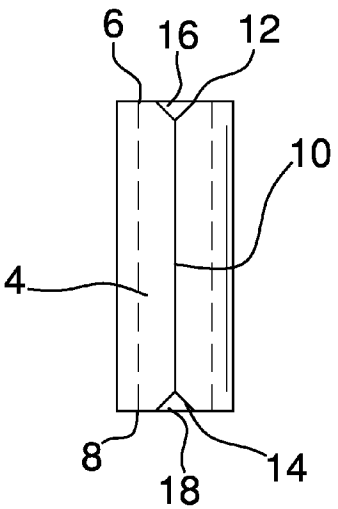
FIG. 4 shows a bottom view of a hanging folder stop, with the slotted opening being positioned in a closed position.

With reference now to the drawings, and in particular to FIGS. 1 through 5 thereof, a new hanging folder stop embodying the principles and concepts of the present invention and generally designated by the reference numeral 2 will be described.

As best illustrated in FIGS. 1 through 5, the hanging folder stop 2 comprises a plurality of lengths of plastic tubing 4 that has two ends comprising a first end 6 and a second end 8. Each length of tubing 4 itself can have a variety of lengths and diameters, but preferably, has a length of approximately one inch and a diameter of approximately ⅜ of an inch. Each tubing 4 is also made from a substance that provides it with a medium level of flexibility, thereby not making it too rigid nor too soft when in use.

A slotted opening 10 is located along the length of each plastic tubing 4, with the slotted opening 10 having two ends comprising a first end 12 and a second end 14. Preferably, the slotted opening 10 runs the entire length of each plastic tubing 4 and is usually in a closed position due to the medium level of flexibility of the plastic tubing.

The hanging folder stop 2 also includes a pair of notches comprising a first notch 16 and a second notch 18. The first notch 16 is located near the first end 6 of each plastic tubing 4 while the second notch 18 is located near the second end 8 of each plastic tubing 4. The first notch 16 overlaps the first end 12 of the slotted opening 10, while the second notch 18 overlaps the second end 14 of the slotted opening 10. Each of the notches preferably has a triangular, indented shape.

The hanging folder stop 2 is used in conjunction with a filing cabinet drawer 24, with the drawer 24 having a front panel 30 that has an attached handle 34. A left side wall 26 and a right side wall 28 are attached to the front panel 30, with a rear panel 32 being attached to the left side wall 26 and right side wall 28. Each hanging folder stop 2 would be removably placed on either ii the left side wall 26 or the right side wall 28.

A series of hanging folders 36 are placed within the drawer. Each hanging folder 36 has two claps comprising a left clasp 37 and a right clasp 38, with the left clasp 37 to be placed over the left side wall 26 and the right clasp 38 to be placed over the right side wall 28. Sometimes, without more, this type of arrangement is not ideal because the folder 36 must remain virtually parallel to the front panel 30 and rear panel 32. If it is not, then one or both of the clasps 37 and/or 38 will become detached from its associated side wall, and when that happens, the folder and its contents will crash down within the drawer 24.

The hanging folder stop 2 can be used to alleviate this concern. Generally, the stop 2 is placed on the drawer 24 in pairs. Each pair of stops 2 used by a person would have one of the stops 2 placed on the left side wall 26 and the other stop on the right side wall 28. If several pairs of the stops 2 were utilized, then use of the stop 2 with the drawer 24 could create several different pockets 40 in association with the drawer 24 and prevent the drawer and it's contents from falling into the drawer. In such a scenario, the left clasp 37 of each folder 36 would be in between two hanging folder stops 2 on the left wall 26 of the drawer 24 and the right clasp 38 of each folder 36 would also be in between two hanging folder stops 2 located on the right wall 28 of the drawer 24.

Optionally, each length of plastic tubing 4 of each hanging folder stop 2 can have a pair of grips 20 and 22 attached to it. Each of the grips 20 and 22 would be located almost opposite that of the location of the slotted opening 10, with the midpoint 41 between the grips 20 and 22 being located exactly opposite the slotted opening 10. The grips 20 and 22 would allow an individual to more easily open up the slotted opening 10 by grasping the grips 20 and 22 and squeezing them together, thereby facilitating the placement and removal of each length of plastic tubing 4 of each hanging folder stop 2 on the left wall 26 and/or right wall 28 of a drawer 24 by causing the slotted opening 10 to temporarily widen. Alternatively, an individual could then release the hold on the grips 20 and 22, thereby allowing the length of plastic tubing 4 of each hanging folder stop 2 to more firmly grip the drawer 24 because the slotted opening 10 would close up. Each grip would preferably have a semicircular shape.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A hanging folder stop in combination with a drawer, the hanging folder stop comprising:

at least one length of plastic tubing having a first end and a second end;

means for removably mounting each length of plastic tubing on the drawer comprising:

a slotted opening located on each length of plastic tubing, wherein each slotted opening has two ends comprising a first end and a second end, wherein the slotted opening runs the entire length of each length of plastic tubing;

wherein the slotted opening removably receives a portion of a left side wall the drawer and alternately a right side wall of the drawer;

a first grip and a second grip, wherein each of the first and second grips is centrally attached to each length of plastic tubing between the first end and the second end;

wherein the first and second grips are configured to separate from each other on a particular length of plastic tubing to widen the slotted opening;

wherein the slotted opening is configured to slip over one of a left side wall and alternately over a right side wall of the drawer;

wherein each of the first and second grips is located almost opposite the location of the slotted opening;

a defined midpoint located halfway between the grips being located exactly opposite the slotted opening;

wherein each of the first and second grips has a semicircular shape.

2. A hanging folder stop in combination with a drawer according to claim 1 wherein each length of plastic tubing comprises a pair of notches comprising a first notch and a second notch, wherein the first notch is located near the first end of each length of the plastic tubing;

further wherein the second notch is located near the second end of each length of the plastic tubing;

further wherein the first notch overlaps the first end of the slotted opening on the length of plastic tubing; and further wherein the second notch overlaps the second end of the slotted opening on the length of plastic tubing.

3. A hanging folder stop in combination with a drawer according to claim 2 further comprising:

a pair of clasps comprising a left clasp and a right clasp, wherein each of the clasps is attached to a folder;

further wherein the left clasp of each folder is placed over the left side wall of the drawer; and further wherein the right clasp of each folder is placed over the right side wall of the drawer.

* * * * *